United States Patent [19]

Gotoh et al.

[11] 4,230,084

[45] Oct. 28, 1980

[54] ENGINE STARTING DEVICE

[75] Inventors: Isamu Gotoh, Kiyoseshi; Yoshinori Okamoto, Kawagoeshi; Goroei Wakatsuki, Oimachi, all of Japan

[73] Assignee: Honda Giken Kogyo Kabushiki Kaisha, Tokyo, Japan

[21] Appl. No.: 28,522

[22] Filed: Apr. 9, 1979

Related U.S. Application Data

[62] Division of Ser. No. 779,604, Mar. 21, 1977, Pat. No. 4,176,648.

[30] Foreign Application Priority Data

Mar. 24, 1976 [JP] Japan ..... 51-32096
Apr. 24, 1976 [JP] Japan ..... 51-51822[U]

[51] Int. Cl.[3] ..... F02N 3/04; F02N 5/02
[52] U.S. Cl. ..... 123/179 S; 123/185 C
[58] Field of Search ..... 123/179 S, 179 SE, 179 R, 123/185 R, 185 BA, 185 S, 185 C; 74/6; 185/39, 41 A, 43; 180/219

[56] References Cited

U.S. PATENT DOCUMENTS

| | | | |
|---|---|---|---|
| 3,692,010 | 9/1972 | Dooley et al. | 123/185 C |
| 3,782,356 | 1/1974 | Hamman | 123/185 C |
| 4,067,243 | 1/1978 | Kurata et al. | 123/179 S |
| 4,091,887 | 5/1978 | Kurata et al. | 123/179 S |
| 4,096,842 | 6/1978 | Kurata | 185/39 |

FOREIGN PATENT DOCUMENTS

| | | | |
|---|---|---|---|
| 2713075 | 10/1977 | Fed. Rep. of Germany | 123/179 S |

*Primary Examiner*—P. S. Lall
*Attorney, Agent, or Firm*—Irving M. Weiner; John L. Shortley; Melvin Yedlin

[57] ABSTRACT

An engine starting device for starting an engine by connecting an output member on the side of a spiral spring and an input member on the side of the engine with each other when the force accumulation by the spring is released. A driving member is driven by the output of the engine. An automatic force accumulating operation for the spiral spring is driven by the driving member. A one-way clutch mechanism connects the automatic force accumulating operation means in a winding pressure accumulating mechanism for the spiral spring with each other.

5 Claims, 14 Drawing Figures

A
B
C
D
E
a
b

ENGINE STARTING DEVICE

This is a division of application Ser. No. 779,604 filed Mar. 21, 1977, which issued as U.S. Pat. No. 4,176,648 on Dec. 4, 1979.

The present invention relates to an engine starting device adapted to start an engine by the release of the accumulated force of a spiral spring.

More particularly, the present invention relates to an engine starting device which is provided with an automatic spiral spring force accumulating mechanism driven by the engine power together with an artificial engine starting spiral spring force accumulating mechanism, so that the starting spiral spring pressure is accumulated by the engine power and no force accumulating operation at the time of re-starting the engine is required.

BACKGROUND OF THE INVENTION

A self-starting motor system operated with a switch or a kick pedal system operated with the foot of the operator has been extensively used for an engine starting device for vehicles such as, for example, motorcycles. However, in the former, though the starting operation is easy, the self-starting motor is expensive, the battery has to be of a large capacity, and the cost including the starting device is high. In the latter, though the cost is low, skill is required with a large operating force.

Therefore, in case it is attempted to make a motorcycle light and small, to provide it at a low price, and to make it easily operable and conveniently utilizable even by ladies or the like, there will be problems with the conventional engine starting devices. In the self-starting motor system, there is a problem in cost. In the kick starter system, there is a problem of it being hard to operate by ladies or the like.

SUMMARY OF THE INVENTION

The present invention provides an engine starting device including an input member mechanically and operably connected to an engine. The device also includes a spiral spring, and an output member mechanically and operably connected to the spiral spring. A driving member is operably connected to and driven by the engine. Automatic force accumulating means is operably connected to the spiral spring for accumulating force in the spiral spring. The driving member is operably connected to the automatic force accumulating means for driving the automatic force accumulating means. A winding pressure accumulator mechanism is operably connected to the spiral spring. A first one-way clutch means selectively connects the automatic force accumulating means with the winding pressure accumulating mechanism. Also provided is means connecting the output member to the input member when the force accumulated by the spiral spring is released to start the engine.

The present invention provides an engine starting device of a spiral spring force accumulating type whereby a spiral spring force is accumulated, and is released to start the engine to effectively solve the problems of the conventional engine starting devices in providing an a motorcycle which is light and small, is provided at a low price, and can be easily and conveniently run and operated even by females.

In the present starting device, a spiral spring is wound to accumulate a pressure by the operation of treading an operating member, such as a pedal arm, and then, after the accumulation of the pressure, the accumulated force of said spring is released to forcibly rotate the crankshaft to start the engine. According to this device, in contrast to the kick pedal system, the engine can be started by the operation of releasing the accumulated force with a lever after the repeated force accumulation by a simple foot treading operation. Therefore, even a lady or the like can very easily and positively start the engine of a motorcycle, and the device is much less expensive than the self-starting motor device.

In this engine starting device by the spiral spring force accumulation, after the engine starting operation, the accumulated spring force will vanish. Therefore, to re-start the engine, the force accumulating operation will have to be made again by an operation, such as treading the pedal with the foot. Its operation is made much easier than that of the kick pedal type starting means, but is more troublesome than that of the self-starting motor type starting means. Therefore, to make a motorcycle small and light and to make it easily and conveniently operable even by weak persons, it is necessary to make the re-starting operation simpler and easier.

In case a spiral spring force accumulating type starting device is used not only for a motorcycle engine, but also for a small engine, such as a general purpose engine, if the re-starting operation can be made without the force accumulating operation at the time of re-starting the engine, it will be convenient and advantageous to the handling of this kind of engine.

An object of the invention is to provide a spiral spring accumulated force releasing type engine starting device wherein the engine can be re-started without spiral spring force accumulating operation such as a pedal operation at the time of re-starting the engine.

Another object of the invention is to provide an engine starting device wherein a spiral spring released after the starting operation is automatically wound to accumulate a pressure with the power of the engine, the pressure can be automatically accumulated without requiring any particular force accumulating operation in advance, and re-starting in the spiral spring force accumulating type is made very easy and convenient.

An object of the invention is to provide an engine starting device wherein, in case it is used as a device for starting the engine of a small light motorcycle, the operation will be made so convenient and easy that the engine will be able to be operated easily, conveniently, safely and positively even by ladies or the like and, in case it is applied to a general purpose small engine, the engine will be able to be re-started simply and conveniently.

A further object is to provide an engine starting device wherein a force is accumulated by utilizing the power of the started engine. The automatic force accumulating mechanism is attained only by providing a member driven by the engine power, setting it in parallel with an artificial force accumulating operation mechanism, and interposing a clutch means between them. Therefore, the automatic force accumulating mechanism may be connected or disconnected through the clutch means without changing the artificial force accumulating operation mechanism. The above mechanism is attained with a simple structure, and re-starting is made easy at a low cost.

There is provided an engine starting device which can be obtained inexpensively while increasing the startability in applying it to a small light motorcycle which can be easily and conveniently operated even by weak persons.

In the starting device of the invention, a clutch means engaging only at the time of starting the engine is provided between the crankshaft and a spiral spring output member provided in a position opposed to it. A force accumulating operation shaft of this spiral spring is also provided, is extended out to wind the spring to accumulate a force by the operation of treading a pedal arm with the foot, and is provided with a clutch means for connecting the shaft and spring with each other at the time of the artificial operation. The member driven by the power of the engine is connected with the clutch member provided on the operating shaft. The spring and driving member are disconnectably associated with each other so that the spring may be automatically wound by engine power.

The driving member which winds the spring by engine power is driven positively by a cam, lever and arm. The cam is driven by a shaft connected with the driving shaft of the driving wheel driven by engine power. The spiral spring winding means is fed to wind the spring through the clutch means by rocking the arm or the like engaged with said cam. The cam may be driven by a member connected with the output shaft or crankshaft of the engine without being driven by the engine output end. It is preferable to use as a cam, a member such as a half body of a centrifugal clutch interposed between the spiral spring and crankshaft.

A ratchet or ball clutch is used for a one-way clutch transmitting the driving force of the arm or the like driven by the engine power to the spring winding member to transmit the driving force of the arm or the like only in the winding direction to the spiral spring winding member.

By such means, the spiral spring accumulated force having been depleted after the engine is started, is automatically restored by the engine power to be prepared for re-starting the engine. The engine can be readily started without requiring an artificial winding operation at the time of re-starting it.

DETAILED DESCRIPTION

Figure 1:
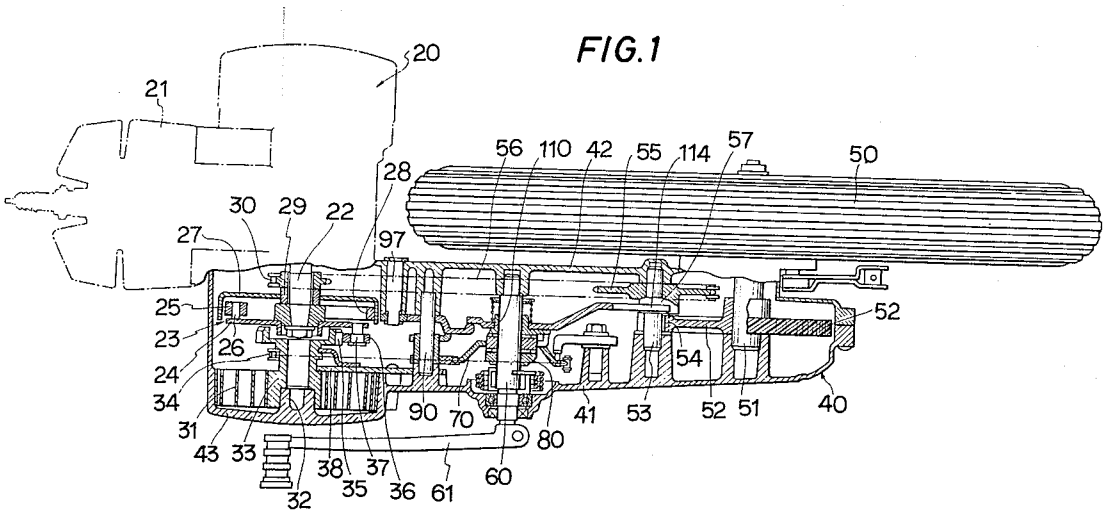
FIG. 1 is an explanatory cross-sectioned plan view of a first embodiment of the present invention as applied to an autobicycle or motorcycle.
Figure 2:
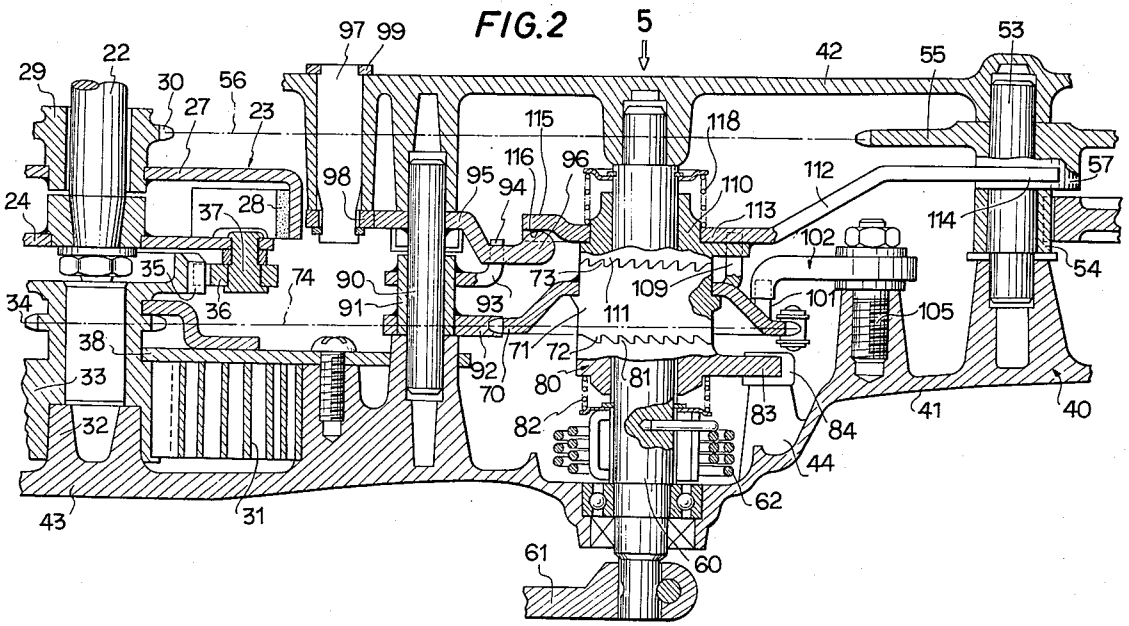
FIG. 2 is a magnified view of an essential portion of FIG. 1.

FIG. 1 shows a general scheme of a spiral spring force accumulating type starting device including a starting device of the invention. FIG. 2 shows essential portions magnified.

Reference numeral 20 represents a power unit mounted on a motorcycle or autobicycle. A transmission casing 40 is provided between engine 21 and rear wheel 50, is formed by combining both right and left side walls or half bodies 42 and 41, and has fitted within it a transmission mechanism and a starting device according to the present invention.

A centrifugal clutch 23 is provided in the end portion on the casing side of a crankshaft 22 of engine 21. A centrifugally expanded type friction member 25 is pivoted with a pin 26 on the surface on the engine side of a half body 24 which is a plate-shaped output member fixed to the end of the crankshaft 22. A disk-shaped half body 27, which is an input member opposed to half body 24, is provided on crankshaft 22. Half body 27 is fixed to a sleeve 29 loosely fitted on crankshaft 22, and is provided on the inside surface of its flange portion with a friction member 28 to be frictionally engaged with member 25. A driving sprocket 30 is integrally provided on sleeve 29, and is connected with a driven reduction sprocket 55 of rear wheel 50 through a chain 56. Sprocket 55 is provided in the rear portion of casing 40, and is fixed to a pivot shaft 53 provided between half bodies 41 and 42. Pivot shaft 53 is provided with a gear 54 meshing with a gear 52 provided on a rear wheel axle 51 so that engine power may be transmitted to wheel 50 through driving sprocket 30, chain 56, reduction sprocket 55, shaft 53, gears 54 and 52, and axle 51.

A circular space is formed so as to be a spiral spring containing portion 43 in a portion which is the front portion of half body 41 and faces the end of crankshaft 22. A spiral spring 31 is contained in the containing portion 43, and is locked at its outer peripheral end to a portion of the inside wall of the containing portion 43, and at its inner end to a portion of a sleeve 33. Sleeve 33 is loosely fitted and supported in the base portion on a boss 32 provided to coaxially project out of the inside wall of the containing portion 43 to face crankshaft 22 on the inside wall of containing portion 43. Sleeve 33 is provided with a spring winding driven sprocket 34 on the outer periphery of its intermediate portion, and is provided with a ratchet 35 at its free end, i.e., on the crankshaft 22 side. A centrifugally expanding type pawl 36 is pivoted with a pin 37 outside half body 24 in the end portion of the crankshaft to form a centrifugal clutch at the time of starting the engine with the spiral spring. On the side surface on the crankshaft side of spring 31, there is provided a regulating plate 38 to prevent the spring from springing out.

When the regulation of the force accumulation of spring 31 is released, the sleeve 33 will be rotated by its resiliency, the half body 24 will be rotated and driven by the engagement of pawl 36 with ratchet part 35, and crankshaft 22 will thus be driven to start the engine. After the engine starts, when the number of revolutions of crankshaft 22 rises to be above a fixed value, the pawl 36 will be expanded by centrifugal force and will be disengaged from ratchet 35, i.e., will be isolated from the starting mechanism operated by spring 31. With increase in the number of revolutions of the engine, the friction member 25 of half body 24 will expand to engage friction mechanism 28 of the other half body 27, and the engine output will thus be transmitted to the rear wheel 50 side as described above through sprocket 30.

A spring winding and force accumulating mechanism and releasing mechanism are provided between the mechanism of spring 31 starting the crankshaft 22 and the transmission and reduction mechanism of the rear wheel, and will now be explained in detail.

An operating shaft 60 is rotatably mounted and set between the right and left side walls 42 and 41 between the above-mentioned mechanism of the casing 40 and is extended at one end out of wall 41. An operating pedal arm 61 is connected and secured to this extended portion, and is extended forwardly along the outside surface of wall 41.

A base or driven clutch member 71 (FIG. 2), which comprise a driven clutch member having teeth 72 and 73 formed on both surfaces in the axial direction, is provided on the periphery of the intermediate portion of shaft 60. Member 71 is rotatably fitted to shaft 60, is regulated in the axial direction, and is held in the intermediate portion. A spring driving sprocket 70 is integrally fixed to the outer periphery of member 71 by providing a fitting step portion or the like. Member 71 forms a portion of sprocket 70. Sprockets 70 and 34 are connected to each other through a chain 74. Teeth 72 and 73 are formed in the same direction to form a one-way clutch. Two driving clutch members 80 and 110, having teeth 81 and 111, respectively, meshing respectively with the teeth 72 and 73 only in one direction, to drive member 71 only in one direction, are provided on shaft 60 on both sides in the axial direction of member 71.

The first driving clutch member 80, forming a portion of an artificial force accumulating operation mechanism, is slidable in the axial direction and is regulated in the rotating direction by a spline-fitting on the pedal arm 61 side of the member 71 so that its teeth 81 may mesh with teeth 72 of member 71. Shaft 60 is supported by a return spring 62, and is resiliently pressed to return pedal arm 61 and shaft 60 to predetermined positions when the tread on arm 61 is released.

Figures 3, 4, 5:
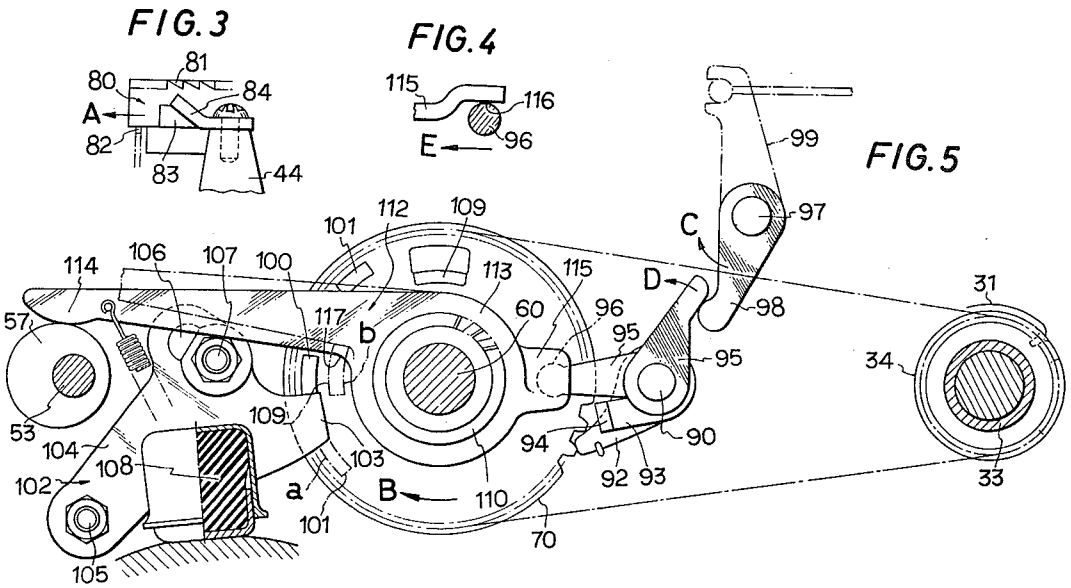
FIG. 3 is a view showing an essential portion of a clutch part of an artificial force accumulating operation mechanism.
FIG. 4 is an explanatory view showing an essential portion of a part disengaging a clutch means of an automatic force accumulating mechanism.
FIG. 5 is an explanatory view of the mechanism as seen in the direction indicated by the arrow 5 in FIG. 2, with the case side wall removed.

As shown in FIG. 3, a cam 83 is provided to project in a proper position on the outer periphery of member 80. A guide cam piece 84 is provided on the rotary track integral with the member 80 of the cam 83, and is fixed to a supporting part 44 provided to project inside wall 41. Cam 83 engages with guide cam piece 84 in a predetermined position at the normal time of the member 80 integral with shaft 60 due to the action of the return spring 62 and acts to separate members 80 and 71 against the spring 82 so that teeth 81 may be separated from teeth 72 and members 80 and 71 may be thus isolated from each other.

When arm 61 is trod down to rotate shaft 60 in the normal direction, the first driving clutch member 80 will also rotate in the same direction and, with the variation of its rotating angle, the cam 83 will integrally move in the direction indicated by arrow A in FIG. 3 to separate from the guide cam piece 84. Due to the action of the clutch spring 82, the member 80 will slide on shaft 60 toward the driven clutch member 71 and the teeth 81 will mesh with the teeth 72. The intermittent rotation of shaft 60 by the up-and-down motion of arm 61 will thus be transmitted to the driven clutch member. Thus, the integral driving sprocket 70 will intermittently rotate, and the driven sprocket 34 will be intermittently rotated through the chain 74 so that spring 31 may accumulate a force. When shaft 60 is returned and reversely rotated by the return spring 62, i.e., when the tread on the pedal arm 61 is released, the member 80 will reversely rotate integrally with shaft 60, the cam 83 will engage with guide cam piece 84 and will retreat in the axial direction, and the mesh of teeth 72 and 81 will be released, i.e., the driven clutch member 71 and driving clutch member 80 will be separated and isolated from each other.

A pivot shaft 90 is provided parallel and adjacent to shaft 60. A sleeve 91 is rotatably fitted on the periphery of the intermediate portion of shaft 90, and has a stopper 92 and operating arm 93 fixed to its outer periphery. As shown in FIG. 5, stopper 92 comprises a pawl-shaped body engaged with the teeth of sprocket 70 by the resiliently pressing action of a spring or the like to prevent the reverse rotation of sprocket 70 from being caused by the resiliency of the force accumulating spiral spring, and to allow only the normal rotation of sprocket 70 indicated by arrow B in FIG. 5. Arm 93 engages with an operating member 95 fixed to shaft 90 through an extended portion 94. Member 95 is provided with a separating projection 96 at its tip to also be a means of separating the second driving clutch member 110, and is engaged with an operating arm 98 of another adjacent pivot shaft 97. As shown in FIG. 5, shaft 97 is connected in its end portion extending out of wall 42 of case 40 with a releasing arm 99 which is connected with a releasing pedal or lever (not illustrated) through a cable. By the releasing operation, arm 99 will rock clockwise with shaft 97 as a fulcrum, the arm 98 integral with shaft 97 will rock clockwise as indicated by arrow C, and member 95 engaged with it will rock counterclockwise as indicated by arrow D. Arm 93, engaged in its extended portion 94 with member 95, will rock. Stopper 92 provided integral with arm 93 on common sleeve 91 will rock in the releasing direction to disengage from the teeth of sprocket 70. Therefore, the entire driven clutch member 71 will be released, and the spring 31 having accumulated the force will be free to start the engine as described.

As shown in FIG. 5, regulating members 100 and 101, regulating the winding angle of spring 31, are provided on one side surface of sprocket 70; one being a winding angle regulating member 101, and the other being a returning angle regulating member 100. A cushion unit 102, for regulating the winding angle and returning angle, is provided on the track of member 100. Members 100 and 101 have the position shown in FIG. 5 as a starting point. With intermittent rotation in the direction of arrow B of sprocket 70 by driving member 80, one member 101 will collide in the illustrated angular position a with a regulating arm 103 of unit 102 (as shown by the phantom line) to regulate further rotation of sprocket 70. The spring winding angle will be regulated to end the winding operation in this position.

In case sprocket 70 is reversely rotated by the release of the force accumulation when stopper 92 is released, the returning angle regulating member 100 will collide with the upper surface of arm 103 to regulate the returning angle. In order to cushion the respective collisions of members 101 and 100, the body 104 of unit 102 is pivoted in its base portion to the casing side with a pin 105, is provided with a slot 106 in its free end portion, and is engaged and supported with a pin 107 to be rockable. Cushion material 108, such as a cushion rubber, is fitted between body 104 and the bottom in the casing to cushion the collision shocks.

The automatic force accumulating mechanism will now be explained in detail.

Member 110 forms a portion of the automatic force accumulating mechanism. Member 110 is slidable in the axial direction and rotatable on shaft 60. A driving arm 112 is integrally secured to the base portion 113 of member 110 and extends in its free end portion toward shaft 53. This extended portion is engaged in its end portion 114 with cam 57 formed in the boss portion of sprocket 55. Cam 57 may be provided integrally with sprocket 55, may be provided separately and made integral with the boss portion of the sprocket, or may be provided separately or integrally on the periphery of shaft 53 to rotate with shaft 53 or sprocket 55.

A clutch spring 118 (FIG. 2) is provided on the side of member 110, and is so set as to resiliently press member 110 toward the driven clutch member 71 and to mesh teeth 111 and 73. A separating projecting piece portion 115 (FIGS. 2, 4 and 5) is provided in a part of base portion 113. A concavity 116 is formed in projecting piece portion 115 (FIG. 4). Separating projection 96 of operating member 95 is engaged with concavity 116.

An automatic winding releasing member 109 for spring 31 is provided on the side of sprocket 70 having regulating members 100 and 101, projects in the axial direction, and is set to collide with the base portion 117 of the extended arm-shaped portion of arm 112 near the spring winding angle regulating position.

At the time of running by the drive of the engine or by inertia, the second driving clutch member 110 will act to wind in spring 31. After the engine is started, the sprocket 55 will be rotated by the drive of the engine, and the cam 57 will be rotated and driven. Arm 112, engaged in its end portion 114 with cam 57, will be rocked up and down with the shaft 60 as a fulcrum. Member 110 integral with arm 112 will intermittently rotate by a predetermined angle in the normal direction, and the intermittently rotating torque of member 110 will be transmitted to driven member 71 by the meshing of teeth 111 and 73. As a result, the sprocket 70 will be intermittently rotated and driven a predetermined angle in the normal direction, i.e., the spring 31 will be wound in the force accumulating direction through sprockets 70 and 34 and chain 74. When driving arm 112 is rocked in the reverse direction, as the teeth 111 and 73 of clutch members 110 and 71 are of a one-way clutch, the torque will be transmitted only in the normal direction, and the clutch member 110 will escape in the separating direction on shaft 60 against the spring 118 in the reverse direction.

By repetition of the above, the member 110 will intermittently rotate in turn in the normal direction, i.e., in the direction indicated by arrow B in FIG. 5, and regulating member 101 will approach the spring winding regulating angle. When the winding operation reaches the end point, releasing member 109 will reach the lower surface of the base portion 117 of arm 112, and the arm 112 will thus be lifted upwardly as shown by B in FIG. 5. Thereby, cam 57 and end portion 114 of arm 112 will be disengaged with each other, the transmission of power by cam 57 will be released, and the drive by member 110 will stop.

Thereafter, the drive of the engine will be transmitted to wheel 50 through sprocket 55, shaft 53, gears 54 and 52, and axle 51. The force accumulating operation of spring 31 will be isolated, and only the normal running operation will occur.

In this condition, the sprocket 70, operating to wind in the spiral spring with the drive of the engine, will be engaged and regulated by stopper 92, will be allowed to rotate only normally, will be prevented from rotating reversely, and will operate to automatically wind in the spiral spring until the winding end point while intermittently rotating. At the time of this automatic winding operation member 80 will be separated from member 70. At the time of the input operation, member 110 will slide in the axial direction, and teeth 111 will repeatedly mesh with and separate from teeth 73.

The release of spring 31 having accumulated the pressure by the automatic winding operation, i.e., the engine starting operation, will be made in the same manner as mentioned above. When operating arm 98 is rocked in the direction indicated by arrow C in FIG. 5 by the operation of the lever or pedal, the operating member 95 will be rocked in the direction indicated by arrow D, the stopper 92 will be disengaged from sprocket 70, and sprocket 70 including member 71 will be released. But, prior to this, the following operation will occur. When member 95 is rocked, the separating projection 96 will move in the direction of arrow E (FIG. 4) before it engages with the extended portion 94 of arm 93. As a result, projection 96 will ride on the flat surface portion of the projecting piece portion 115 over the concavity 116. Arm 112, including projecting piece portion 115, will be backed up against spring 118 in the axial direction with member 110 which will be separated from member 71. Thereafter, the stopper 92 will be disengaged from sprocket 70, the spring 31 will be released, the engine will be started, and the member 110 will be protected. At the time of starting the engine, because member 80 will have been separated from member 71 as described above, the engine will be started without trouble.

Figure 6:
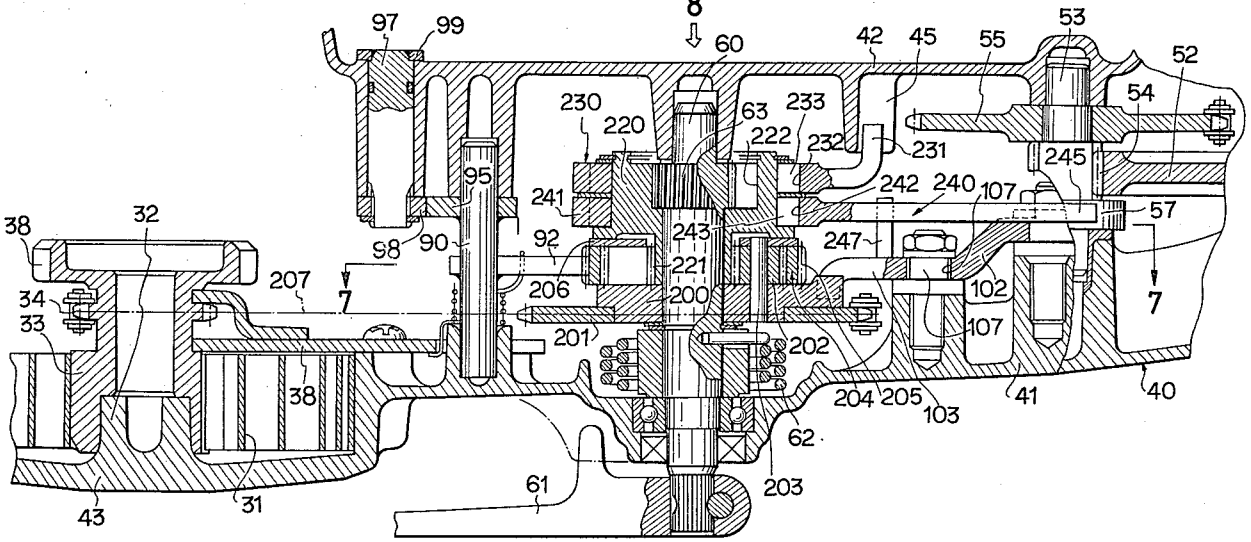
FIG. 6 is a view similar to FIG. 2, showing a second embodiment in which the clutch transmitting mechanism is modified.
Figure 7:
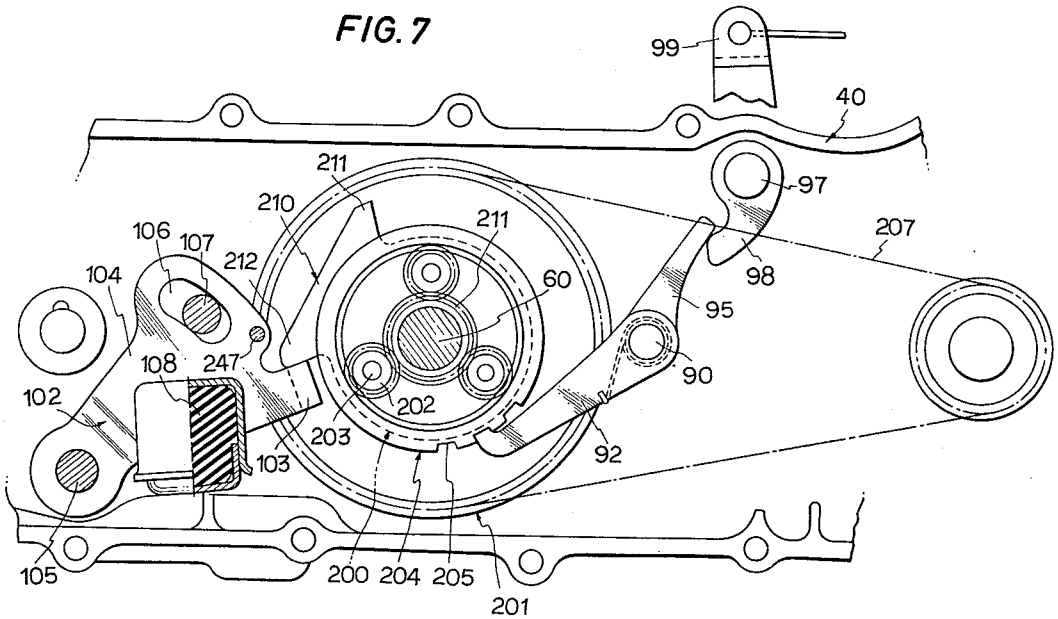
FIG. 7 is a sectioned view taken along line 7—7 in FIG. 6.
Figure 8:
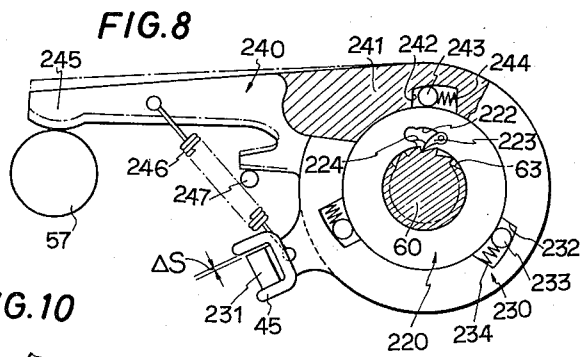
FIG. 8 is a view, partly in section, of an essential portion of the mechanism with the case side plate removed shown in the direction of arrow 8 in FIG 6.

FIGS. 6 to 8 show a second embodiment of an automatic force accumulating mechanism. This is to utilize a planetary gear mechanism instead of the above-mentioned ratchet teeth. This embodiment is different from the first embodiment only in the part of the force accumulating mechanism, but otherwise is the same in the fundamental structure. Therefore, the same corresponding numerals are used for the same parts which can be used in common.

In FIG. 6, which is a view similar to FIG. 2, a flat driving sprocket 201 is rotatably fitted through a boss member 200 on the operating shaft 60, and is connected with the input sprocket 34 of the spiral spring 31 through a chain 207.

A hub 220 is rotatably fitted on shaft 60 so as to be coaxial with the face sprocket 201. Hub 220 is extended in its free end portion adapted to be of a small diameter, toward boss member 220. A gear is formed on the periphery of the extended portion to form a sun gear 221 integral with hub 220. In the illustrated embodiment, as shown in FIG. 7, three planetary gears 202 are arranged and meshed at regular angular intervals on the periphery of sun gear 221. Planetary gears 202 are borne by pins 203 on boss member 200 of sprocket 201. An internally-toothed ring gear 204 is arranged and meshed on the outer periphery of gears 202, and is held between hub 220 and member 200. The end surfaces on the hub side of gears 202 are supported by the combination of a ring 206 (FIG. 6) and pins 203.

Concavo-convex teeth 205 are formed on the outer periphery of gear 204. A stopper 92, secured to a pivot shaft 90, is engaged with teeth 205 to fix gear 204 at the normal time. Stopper 92 is resiliently pressed by a spring in the engaging direction with an operating member 95 which engages with an operating arm 98 secured to a pivot shaft 97 so as to be regulated in its rotation. By the above-described releasing motion of the releasing arm 99 provided at the end of the case extension of the pivot shaft 97, the engagement of stopper 92 with teeth 205 of gear 204 will be released.

A unidirectionally-toothed ratchet 63 is formed on the outer periphery of the portion of shaft 60 fitted with hub 220. As shown in FIG. 8, a concavity 222 is formed in the inside diameter portion of hub 220 to contain a pawl 223, which is resiliently pressed by a spring 224 in the engaging direction to form a one-way clutch.

When the pedal arm 61 of shaft 60 is trod down, the ratchet 63 integral with it will rotate clockwise in FIG. 8 and, as pawl 223 is in the engaging direction, the hub 220 will also rotate in the same direction. Gear 221 integral with hub 220 will be rotated and driven. Because gear 204 is fixed, the planetary gears 202 will revolve while rotating, and sprocket 201 integral with them will be rotated to wind spring 31 through chain 207 to accumulate a force. When arm 61 is released, shaft 60 will be reversely rotated by the action of return spring 62, and pawl 223 will not engage with ratchet 63. The reaction by the force accumulation of spring 31 is received by the fixing of gear 204 by the engagement with stopper 92, and the prevention of the reverse rotation of hub 220 by a roller clutch mechanism, i.e., the fixing of the sun gear. By repetition of the force accumulating operation, the force will be accumulated by spring 31.

An angle regulating part 210, similar to members 100 and 101 shown in FIG. 5, is integrally provided in a portion of the outer periphery of the boss member 200 to regulate the angle by colliding with arm 103 of cushion unit 102. The winding angle will be regulated by the collision of one part 211 of regulating part 210 with arm 103, and the returning angle will be regulated by the collision of the other part 212. FIG. 7 shows the condition in the starting position.

As indicated above, the artificial force accumulating operation mechanism is formed.

The automatic force accumulating operation mechanism will now be explained. A ring-shaped case 230 (FIG. 8) is fitted to the outer periphery of the hub 220, is extended at one end, and is locked in its extended portion 231 to stopper 45 provided on the case 40 side. A clearance $\Delta S$, for separating the later-described roller clutch rocking the case 230 in a minute range, is provided between stopper 45 and extended portion 231.

A plurality (three in FIG. 8) of tapered concavities 232 are provided on the inner periphery of case 230. A roller 233 is fitted in each concavity 232, and is resiliently pressed in the engaging direction by a spring 234 to form a one-way roller clutch mechanism. Roller 233 is in contact with the outer periphery of hub 220 to roll clockwise against spring 224 when hub 220 rotates clockwise in FIG. 8, and to allow rotation of the hub in said direction. Even though hub 220 tends to rotate counterclockwise due to the reaction by the force accumulation of spring 31, the roller 233 will lock on the tapered surface of concavity 232 to prevent reverse rotation of hub 220.

A ring-shaped base portion 241 of a rocking arm 240 is fitted on the outer periphery of hub 220 adjacent and parallel to case 230. Tapered concavities 242 are formed on the inner periphery of base portion 241, and a roller 243, resiliently pressed in the engaging direction by a spring 244, is fitted in each concavity 242 to form a one-way clutch. An extended free end portion 245 of arm 240 is engaged with cam 57 in the same manner as in the first embodiment. Reference numeral 246 represents a spring for making the rocking operation positive.

Cam 57 is driven by the engine power, and arm 240 will rock by a predetermined stroke closkwise in FIG. 8. Roller 243 will be locked by the tapered surface of concavity 242 and the outer peripheral surface of hub 220, and hub 220 will be rotated through a predetermined angle. Sun gear 221 will be rotated, and the planetary gears 202 and the sprocket 201 integral with them will be rotated in the force accumulating direction. In this case, rollers 233 will be in the escaping direction, and therefore hub 220 will be rotated smoothly. In the return stroke of arm 240, the rollers 243 will be disengaged from the tapered surface of concavity 242 and the outer periphery of hub 220. Hub 220 will be locked by the roller clutch mechanism of the case 230. Thus, the reaction by the force accumulation of spring 31 will be received by case 230, and the force will be accumulated in turn by repetition of the above.

At the end of winding the spring 31, in the same manner as in the artificial operation mechanism, one end 211 (FIG. 7) of regulating part 210 will collide with arm 103 of unit 102 to end the winding. At the time of the collision, unit 102 together with arm 103 will be lifted with pin 105 as a fulcrum. A pin 247, provided integral with unit 102, will collide with the lower surface of arm 240 and will lift it to disengage arm 240 from cam 57. At the end of the winding, arm 240 and cam 57 will thus be isolated from each other.

After the end of winding the spring 31 by the above artificial operation or automatic operation, in starting the engine, when shaft 97 is pivotally moved through a cable or the like by a manual operation or the like to rotate shaft 90 counterclockwise in FIG. 7 by arm 98 and member 95, the stopper 92 will be disengaged from concavity 205 to set ring gear 204 free. Planetary gears 202, pins 203 and sprocket 201 will become free. Spring 31 will be released, and the engine will be started as described.

Because the planetary gear mechanism is used, the starting releasing mechanism is in one place, and therefore the mechanism of simultaneously separating the respective systems of the artificial operation and automatic operation, as in the first embodiment, is unnecessary. Because of the roller clutch, there is obtained a winding mechanism having no meshing sound and little noise.

Figure 10:
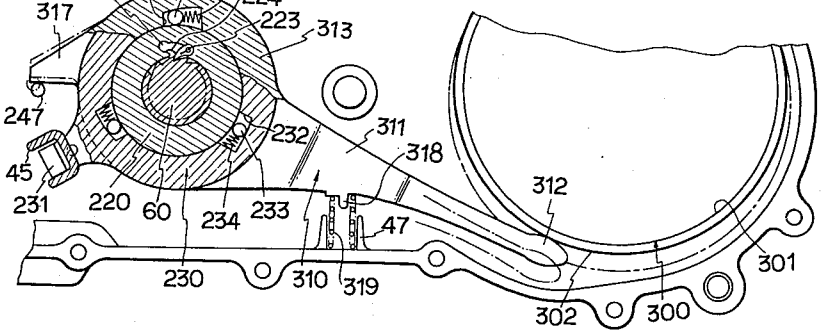
FIG. 10 is a sectioned view taken along line 10—10 of FIG. 9.
Figure 11:
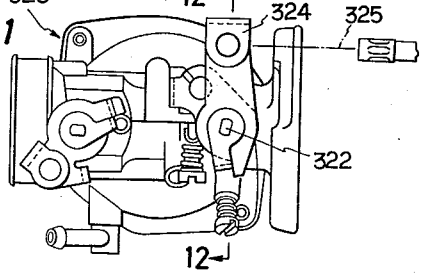
FIG. 11 is a view of a carburetor provided with a throttle valve automatically adjusting device to be auxiliarily used in the embodiment of FIG. 9.
Figure 9:
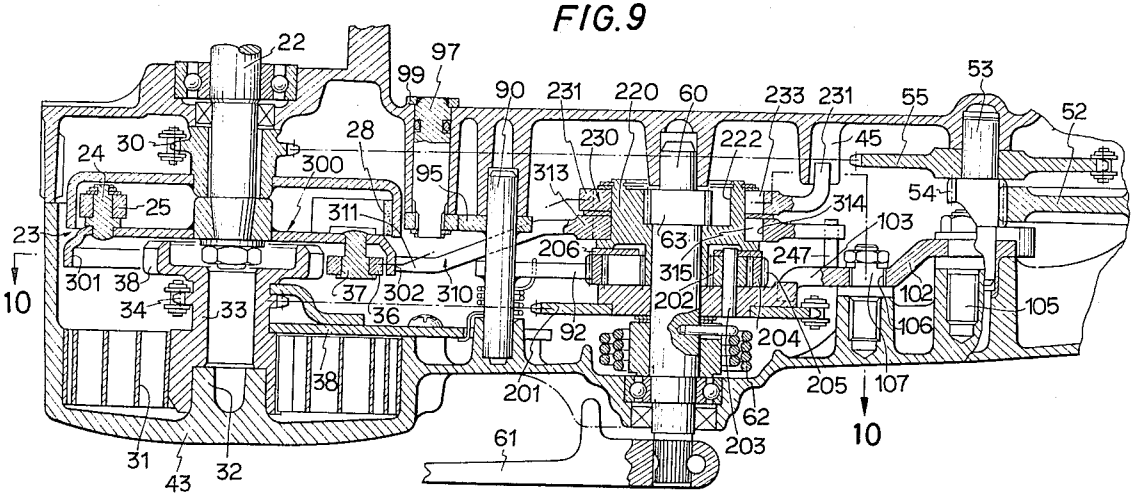
FIG. 9 is a view similar to FIG. 6, showing a modification of the embodiment of FIGS. 6–8.
Figure 12:
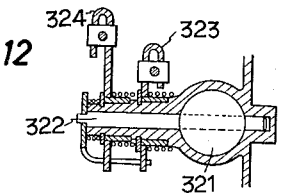
FIG. 12 is a sectioned view taken along line 12—12 of FIG. 11 showing only an essential portion.
Figure 14:
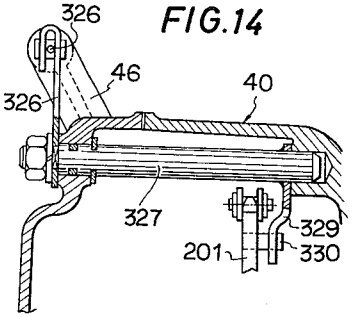
FIG. 14 is a sectioned view taken along line 14—14 in FIG. 13.
Figure 13:
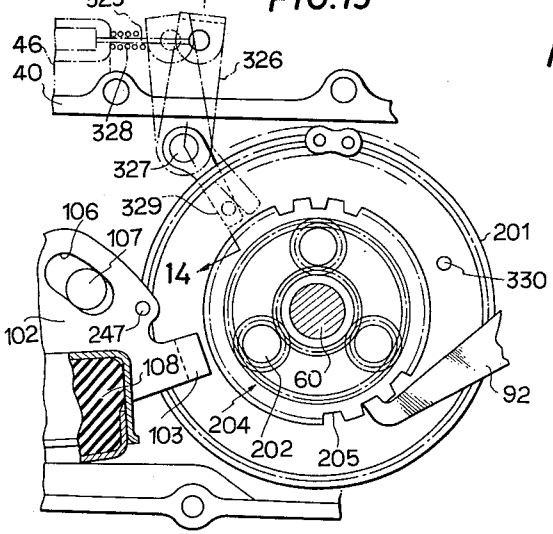
FIG. 13 is a side view of an automatically regulating mechanism.

FIGS. 9 and 10 show a third embodiment. Its fundamental structure is the same as the embodiment shown in FIGS. 6 to 8. Corresponding numerals are used for the same parts.

The third embodiment is to be driven directly with the engine, whereas the other embodiments accumulate a force associated with the wheel driving system after the engine output, i.e., the illustrated embodiment is formed so that a cam is provided on the reduction sprocket shaft 53 and an arm is engaged with the cam to automatically accumulate a force.

In the first and second embodiments, unless the engine is started and run, no force will be able to be accumulated in the spiral spring. On the other hand, if a motorcycle or autobicycle is to be made easily and positively operable even by females or minors, the engine might stop at the time of starting running after the engine is started. In such case, as the autobicycle has not yet run sufficiently, the force to be prepared for re-starting will not yet be accumulated in the spiral spring and it will be necessary to make the force accumulating operation of spring 31 by the pedal arm 61 treading operation.

Therefore, the third embodiment is to drive a driving arm for the force accumulating operation directly by engine 21.

A clutch half body, which is an output member of the centrifugal clutch 23, is an input member at the time of starting, and is secured to crankshaft 22, i.e., a clutch outer member 300 is formed in the shape of a disk provided with a flange portion 301 on its peripheral edge. A cam 302 is formed in the shape of flange 301. An arm portion 311 of a driving arm 310, loosely fitted to the outer periphery of hub 220, is extended toward member 300 and its free end portion 312 is so set to interfere with the outer periphery of cam 302.

A plurality of tapered concavities 314 (FIG. 10) are provided in the inner peripheral portion of base portion 313 of driving arm 310. A roller 315 is fitted in each concavity 314, and is resiliently pressed in the engaging direction by a spring 316. An extended portion 317 is provided on the side opposite arm portion 311 to rock arm 310 clockwise in FIG. 10 with the lifting action of pin 247 of unit 102 and disengage the free end portion of the arm from cam 302. A spring 319 is provided between a locking portion 318, provided in the lower part of arm portion 311, and a tubular receiving portion 47, projecting on the inside bottom of case 40, to resiliently press arm portion 311 into contact at its free end 312 with cam 302.

When crankshaft 22 is driven by starting the engine 21, the clutch outer member 300 will rotate, the driving arm 310 will be rocked by the cam 302, the roller clutch mechanisms 314, 315 and 316 and hub 220 will be intermittently rotated, and an automatic force accumulating operation of the spiral spring will take place.

Thus, with the output of crankshaft 22, the driving arm 310 is rocked to accumulate a force in spring 31. Therefore, before running, or driving, the force will be automatically accumulated while the engine is started and idling and, even if the engine stops at the time of starting running or the like, it will be able to be immediately re-started. Also, because cam 302 is driven by member 300 of a large diameter, the stroke of arm 310 will be large. Thus, the spring force accumulating operation can be completed within a short time.

Since driving arm 310 is driven directly by crankshaft 22, the engine will be loaded in the initial period of starting. Therefore, to make the function of the above-mentioned mechanism more positive, it is preferable to set the number of revolutions of the engine at the time of the winding force accumulating operation to be higher than when idling. Thereby, the automatic force accumulation can be completed earlier.

FIGS. 11 to 14 show a throttle lever, operating a shaft 322 of a throttle valve 321 of a carburetor 320, which is formed to be of two steps of a lever 323 for manual operation and a lever 324 for automatic operation. Automatic operation lever 324 is connected to the free end portion of an arm 326 by a cable 325. Arm 326 is secured to the extended end of a pivot shaft 327 mounted on case 40. A spring 328 is fitted between arm 326 and a bracket 46 supporting the cable 325 to tension the cable 325 and hold the throttle valve 321 opening at the engine warming operation opening or the like larger than the idling opening. A releasing arm 329 is provided on shaft 327. A releasing pin 330 is provided to project on the side surface of driving sprocket 201. Arm 329 projects in the rotary path of pin 330.

When starting the engine, the throttle valve 321 has an opening larger than the lowest idling opening to facilitate engine warming after the engine is started. Arm 310 is rocked by cam 302, and the sprocket 201 is intermittently rotated to make a force accumulating operation. By the rotation of sprocket 201, the pin 330 will move to collide with arm 329 before the spring winding angle regulating position. Arm 329 will be rocked against spring 328 to push back the cable 325 so that the automatic operation lever 324 will return. Then the throttle will be regulated only with manual operation 323.

Thus, the opening of the carburetor can be set to be large in advance, and to be released when the winding of spring 31 is completed.

A friction clutch means or any other suitable clutch means can be employed instead of the illustrated clutch means in any of the embodiments. Further, not only the cam means as described above, but also any other proper means can be used for the engine output detecting means for accumulating the spring pressure.

The present invention has been explained for engine starting devices for autobicycles or motorcycles in the illustrated embodiments, but is not to be limited to them because the invention can be used for starting devices of various engines, such as small engines and general purpose engines.

We claim:

1. An engine starting device comprising:

an input member mechanically and operably connected to an engine;

a spiral spring;

an output member mechanically and operably connected to said spiral spring;

a driving member operably connected to and driven by said engine;

automatic force accumulating means operably connected to said spiral spring for accumulating force in said spiral spring;

said driving member being operably connected to said automatic force accumulating means for driving said automatic force accumulating means;

a winding pressure accumulating mechanism operably connected to said spiral spring;

a first one-way clutch means for selectively connecting said automatic force accumulating means with said winding pressure accumulating mechanism;

means for connecting said output member to said input member when the force accumulated by said spiral spring is released to start said engine;

a cam provided on an output shaft which is also an input member at the time of starting the engine;

said automatic force accumulating operation means comprising an intermittently rotating member rocked by said cam; and said intermittently rotating member and spiral spring winding pressure accumulating mechanism being connected with each other through a one-way clutch.

2. A device according to claim 1, wherein:

a cam is provided on a half body of a one-way clutch secured to the engine crankshaft, and is disposed between the spiral spring force accumulation releasing output member and the crankshaft.

3. A device acording to claim 1, including:

an automatic spiral spring force accumulating operation mechanism rocked by a cam provided on said crankshaft of the engine to intermittently rotate;

an artificial force accumulating operation mechanism rotated intermittently by an artificial operation to wind said spiral spring to accumulate a force;

a spiral spring winding pressure accumulating mechanism; and said winding pressure accumulating mechanism and each of said force accumulating operation mechanisms being connected with each other through a one-way clutch.

4. A device according to claim 1 wherein:

a one-way clutch (23) is formed of the output member of said spiral spring (31) and the input member provided on the engine crankshaft (22);

a driven sprocket (34) winding said spiral spring (31) to accumulate a force is provided on said spiral spring (31) to be driven by a driving sprocket (201) loosely fitted on an operating shaft (60) intermittently rotated and driven by an artificial operation;

an intermittently rotating member (220) is loosely fitted on said operating shaft (60);

a one-way clutch (222–23) is provided between said intermittently rotating member (220) and said operating shaft (60);

an input member (310) rocked by a cam (302) provided on a half body (300) of a one-way clutch (23) of the engine crankshaft (22) is loosely fitted on said intermittently rotating member (220) through a one-way clutch; and said driving sprocket (201) and intermittently rotating member are connected with each other through a planetary gear mechanism (202–206).

5. A device according to claim 4, including:

a mechanism disengaging said input member from said cam (302) in the position of the end of winding said spiral spring (31).

* * * * *